US006052889A

United States Patent [19]

Yu et al.

[11] Patent Number: 6,052,889

[45] Date of Patent: Apr. 25, 2000

[54] RADIO FREQUENCY ANTENNA AND ITS FABRICATION

[75] Inventors: I-Ping Yu, Tucson, Ariz.; Raymond C. Tugwell, Simi Valley, Calif.

[73] Assignee: Raytheon Company, Lexington, Pa.

[21] Appl. No.: 08/752,992

[22] Filed: Nov. 21, 1996

[51] Int. Cl.[7] ..... H01P 11/00

[52] U.S. Cl. ..... 29/600; 343/700 MS; 343/873

[58] Field of Search ..... 29/600, 601; 343/700 MS, 343/853, 873, 770

[56] References Cited

U.S. PATENT DOCUMENTS

| | | | |
|---|---|---|---|
| 3,747,114 | 7/1973 | Shyhalla . | |
| 3,854,140 | 12/1974 | Ranghelli et al. . | |
| 4,298,878 | 11/1981 | Dupressoir et al. . | |
| 4,318,107 | 3/1982 | Pierrot et al. | 343/700 MS |
| 4,499,157 | 2/1985 | Mulliner et al. | 428/624 |
| 4,627,894 | 12/1986 | Monnier | 204/4 |
| 4,819,004 | 4/1989 | Argintaru et al. . | |
| 4,835,539 | 5/1989 | Paschen | 343/700 MS |
| 4,959,658 | 9/1990 | Collins . | |
| 5,172,129 | 12/1992 | Bouko et al. . | |
| 5,402,136 | 3/1995 | Goto et al. | 343/700 MS |
| 5,408,240 | 4/1995 | Battista et al. | 343/853 |
| 5,438,697 | 8/1995 | Fowler et al. | 343/700 MS |
| 5,448,249 | 9/1995 | Kushihi et al. | 343/700 MS |
| 5,495,262 | 2/1996 | Klebe | 343/774 |
| 5,519,406 | 5/1996 | Tsukamoto et al. | 343/700 MS |
| 5,572,222 | 11/1996 | Mailandt et al. | 343/700 MS |

FOREIGN PATENT DOCUMENTS

| | | | |
|---|---|---|---|
| 0200819 | 11/1985 | Germany | 343/700 MS |

OTHER PUBLICATIONS

The Development of Lightweight, Low Cost, Antennas Using Plastic Moulding Techniques by KC Berry, and N Williams, May 1986.

*Primary Examiner*—David P. Bryant
*Assistant Examiner*—Jermie E. Cozart

[57] ABSTRACT

A radio frequency antenna is fabricated by first injection molding a group of broadband radio frequency radiating elements from a polymeric material, metallizing each broadband radio frequency radiating element, and installing a transmission line within each broadband radio frequency radiating element. A support structure is prepared by injection molding at least one, and preferably multiple, flat support plates, and metallizing each plate. A pattern of electrical connectors is formed on the plates. A forward plate has a group of attachment locations thereon, and, collectively, the pattern of electrical conductors provide an electrical feed to each of the attachment locations. A broadband radio frequency radiating element is affixed, preferably by ultrasonic welding, to each of the plurality of attachment locations, with the transmission line of each broadband radio frequency radiating element in electrical communication with the electrical conductor extending to the respective attachment location. The flat plates are connected together, and associated structure, such as feeds, are provided.

17 Claims, 5 Drawing Sheets

RADIO FREQUENCY ANTENNA AND ITS FABRICATION

BACKGROUND OF THE INVENTION

This invention relates to the manufacture and structure of a radio frequency antenna, and, more particularly, to such an antenna fabricated from plastic elements.

An antenna radiates or receives energy. A radio frequency (RF) antenna for use in a microwave radar radiates or receives energy in the radio frequency range that is typically 1–20 GHz (gigahertz), but may be higher or lower. The RF antenna may be structured to radiate or receive energy over a broad bandwidth or a narrow bandwidth. RF antennas are widely used in military applications such as aircraft and missile guidance.

A number of designs of RF antennas are known. Many are based upon microwave waveguide principles, in which a waveguide directs energy in a selected direction and radiates the energy outwardly into free space (or equivalently, receives energy radiated through free space).

The principal known techniques for fabricating RF antennas include foil forming, dip brazing, and electroforming of metallic-based structures. Individual antenna elements are fastened to the feed structure by mechanical fasteners, adhesives, or solders. Mechanical fasteners are time-consuming to install. Adhesives typically require careful application and curing at elevated temperature for an extended period of time. Solders are sometimes difficult to use, especially when there is an attempt to achieve precision alignment of soldered structures. Additionally, all of these techniques result in a relatively heavy antenna structure, which is undesirable in a flight-worthy vehicle.

There is a need for an improved approach to the design and fabrication of RF antennas that reduces both cost and weight of the antenna, and is compatible with either broad band or narrow band applications. The present invention fulfills this need, and further provides related advantages.

SUMMARY OF THE INVENTION

The present invention provides an improved radio frequency (RF) antenna structure and a method for manufacturing the antenna. The antenna is operable for both broadband and narrowband applications, unlike many stripline microwave antennas which are operable only for narrowband applications. The antenna is readily manufactured using mass production techniques and assembly procedures that are amenable to high-rate, low-cost production. The antenna is light in weight, on the order of one-half that of prior antennas with comparable performance.

In accordance with the invention, a method for preparing a radio frequency antenna comprises the steps of preparing a plurality of broadband radio frequency radiating elements, and mounting the broadband RF radiating elements on a support structure with electrical feeds. The broadband RF radiating elements perform much like a dipole antenna element, but have a broader bandwidth. The preparation of the plurality of broadband radio frequency radiating elements includes the steps of molding each broadband radio frequency radiating element from a first polymeric material, metallizing each broadband radio frequency radiating element, and installing a transmission line to each broadband radio frequency radiating element. The support structure has a support base, and a plurality of electrical conductors thereon, with each electrical conductor extending to one of a plurality of attachment locations. Each of the broadband radio frequency radiating elements is affixed to one of the plurality of attachment locations, with the transmission line of each broadband radio frequency radiating element in electrical communication with the electrical conductor extending to the respective attachment location.

The broadband radio frequency radiating elements are preferably manufactured by injection molding, a high-rate, low-cost production technique. The broadband radio frequency radiating elements have a body with an attachment base, two ear-like arms extending from the body in a first direction lying perpendicular to the attachment base, a first transmission line cavity extending in the first direction, and a second transmission line cavity extending in a second direction parallel to the attachment base. The injection-molded broadband radio frequency radiating elements are metallized with a conductive metal such as copper or silver. An L-shaped transmission line, which contains the center conductor of the transmission line and has an overlying insulator, is installed in the transmission line cavities of each broadband radio frequency radiating element. The transmission line cavities and the center conductor form the coaxial line. The center conductor crosses over the opening of the two ear-like arms of the radio frequency radiating elements, launching or receiving the radio frequency energy.

The support base is preferably prepared as two or more molded support plates. The support plates are preferably injection molded from a polymeric material and then metallized. Electrical conductors are provided on the support plates, arranged so as to conduct an electrical signal over a uniform-length path between each of the attachment locations on the support base and the external connectors, to provide equal radio frequency phase or electrical path lengths to each of the broadband radio frequency radiating elements. It would be preferable to use only a single support plate. However, where there are a large number of broadband radio frequency radiating elements, geometrical limitations in providing conducting paths require the use of two or more support plates connected together in a generally facing relationship, with some of the electrical conductors on each of the support plates and brought to the plane of the transmission lines of the broadband radio frequency radiating elements by through-thickness connectors.

Thus, in a preferred embodiment, the required number of flat support plates, electrical conductors preferably in the form of suspended striplines, and external connections are fabricated. These components are assembled to make a feed structure for directing a desired amplitude distribution for transmission of RF energy to the broadband radio frequency radiating elements for emitting, and for conducting the RF energy collected by the broadband radio frequency radiating elements to receiving apparatus. As part of the assembly operation, the broadband radio frequency radiating elements are affixed to the first side of the forward support plate. The fixing is accomplished by ultrasonic welding using an energy director structure having protrusions that concentrate the ultrasonic energy. The ultrasonic welding provides a strong attachment of the broadband radio frequency radiating elements to the support plate, without the use of mechanical fasteners, adhesives, or solder.

The metallized outer surface of the broadband radio frequency radiating elements, on assembly to the forward feed plate, abuts with connection areas on the forward feed plate. A transmission line assembly incorporated within each broadband radio frequency radiating element interconnects via solder with the suspended stripline circuit board traces, located on the aft side of the forward plate. Channels on the forward and center plates form the outer surface of the electrical conductor structure. A center conductor is constructed of etched conductive metal such as copper, with the width and thickness of the center conductor relative to the dimensions of the outer surface determining the impedance of the transmission line.

An injection molded center plate and its suspended stripline circuit board are placed over the rear face of the forward plate and are interconnected with the forward plate circuit board by through-thickness pins. These pins are soldered to copper traces on the aft side of the center plate circuit board.

The aft feed plate has four RF connectors with socket contacts on the forwardly facing surface for interconnecting with respective connection areas on the rear surface of the center plate when assembled thereto. The RF connectors on the rear surface of the aft feed plate provide RF signals that are injected or received to form a monopulse system via a sum and difference network.

The forward, center, and aft feed plates are attached together as an assembly, with the broadband radio frequency radiating elements on the forward feed plate, by any operable approach. In one such technique, the feed plates are ultrasonically welded together using studs that extend between the plates. In another approach, threaded studs and nuts are used to join the plates together.

The broadband radio frequency radiating elements and the feed plates are all made of a polymeric material, and preferably fabricated by injection molding. Although other materials have been found operable, the best material to date for use in molding these components has been found to be glass-fiber-reinforced polyetherimide (PEI). This material has good strength and stability, and additionally is compatible with injection molding.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
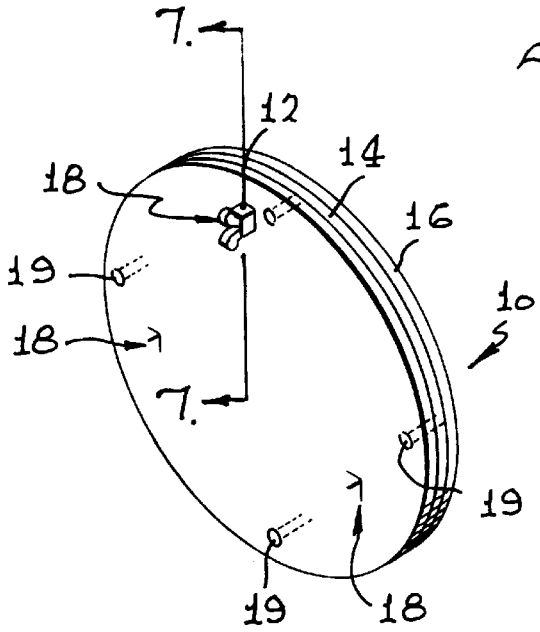
FIG. 1 is a perspective view of the antenna fully assembled.
Figure 2:
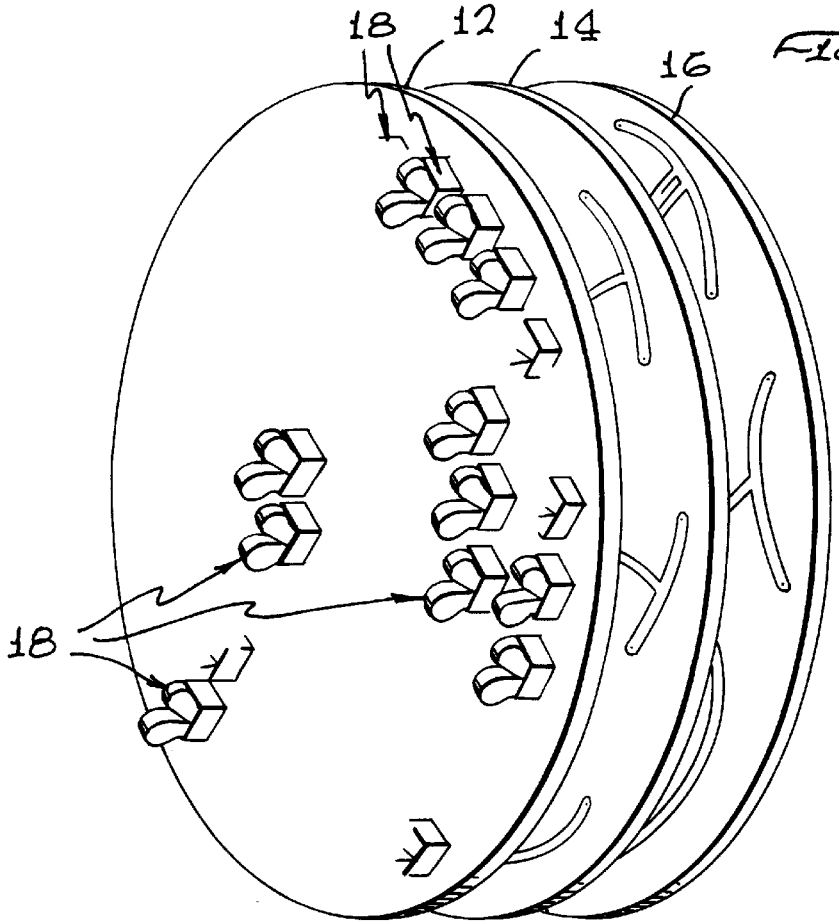
FIG. 2 is an exploded perspective view of the antenna of FIG. 1.
Figure 7:
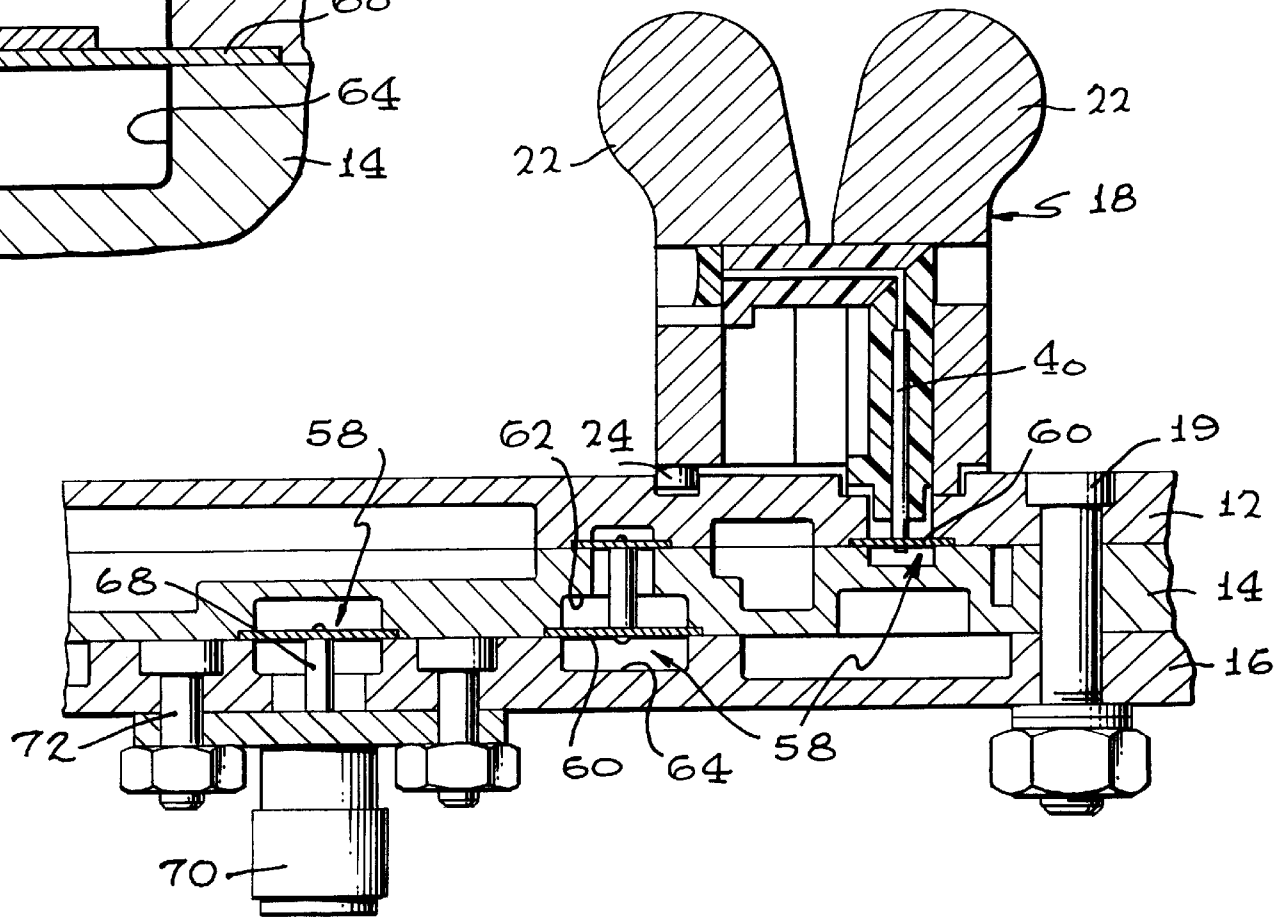
FIG. 7 is a sectional view of the antenna of FIG. 1, taken along lines 7—7.
Figure 8:
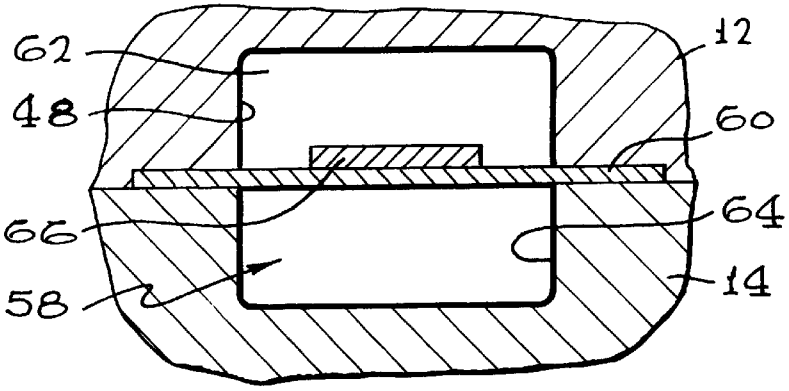
FIG. 8 is a detail sectional view of a suspended stripline.
Figure 9:
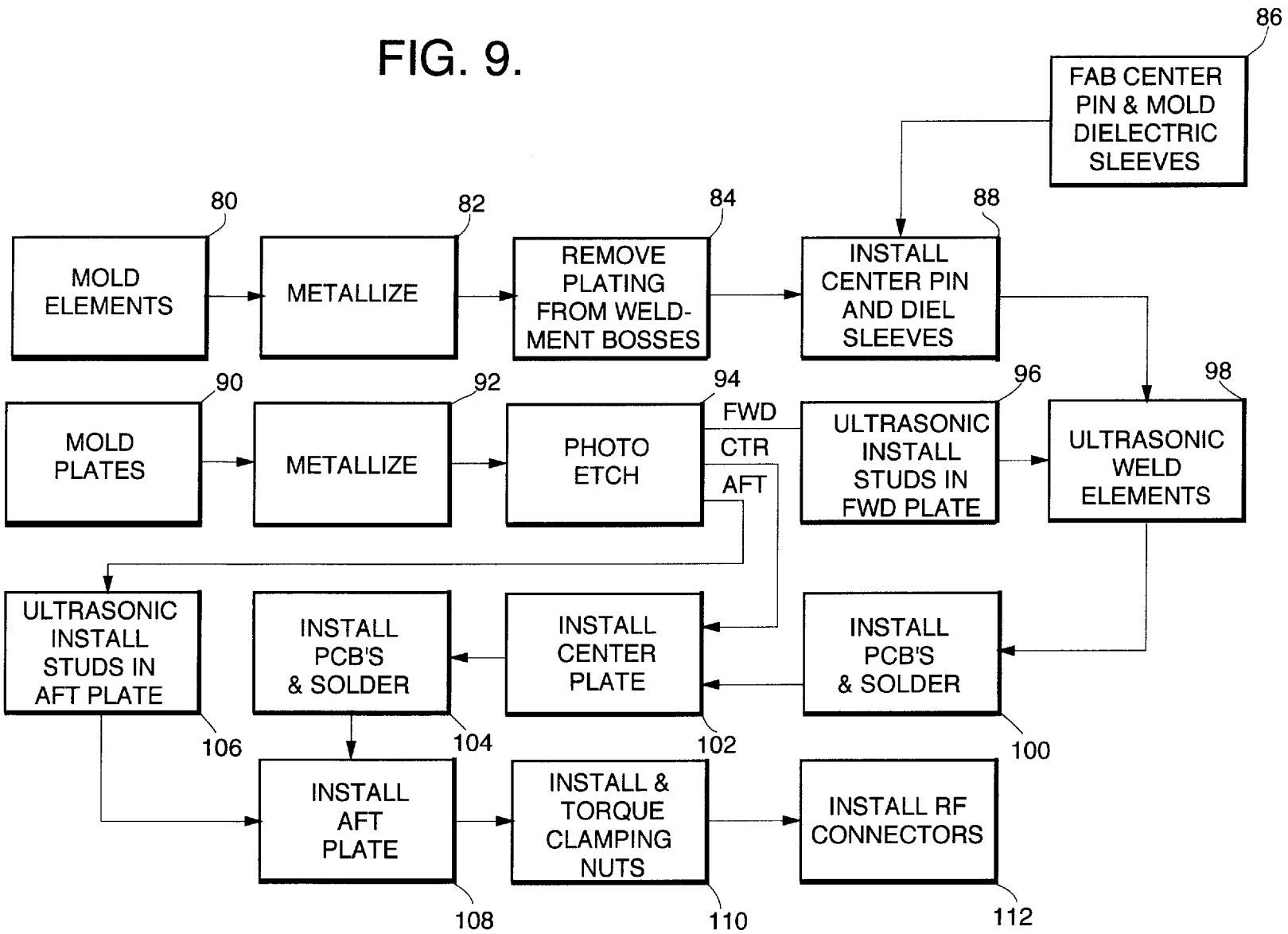
FIG. 9 is a process flow diagram for the preparation of the antenna of FIG. 1.

FIGS. 1–8 illustrate the structure of a preferred embodiment of the invention, and FIG. 9 illustrates a process for preparing this preferred embodiment. Referring to FIGS. 1 and 2, a radio frequency antenna 10 is an assembly of four major parts: a forward feed plate 12, a center feed plate 14, and an aft feed plate 16, and a plurality of broadband radio frequency radiating elements 18. Each of the feed plates is a substantially flat plate, but each has channels and other detail features therein as will be discussed. The plurality of broadband radio frequency radiating elements 18 are affixed to a first side of the forward feed plate 12. The three feed plates 12, 14, and 16 are assembled into a unitary structure by stud members 19, which are illustrated as threaded studs but could be ultrasonically welded studs.

Figure 3:
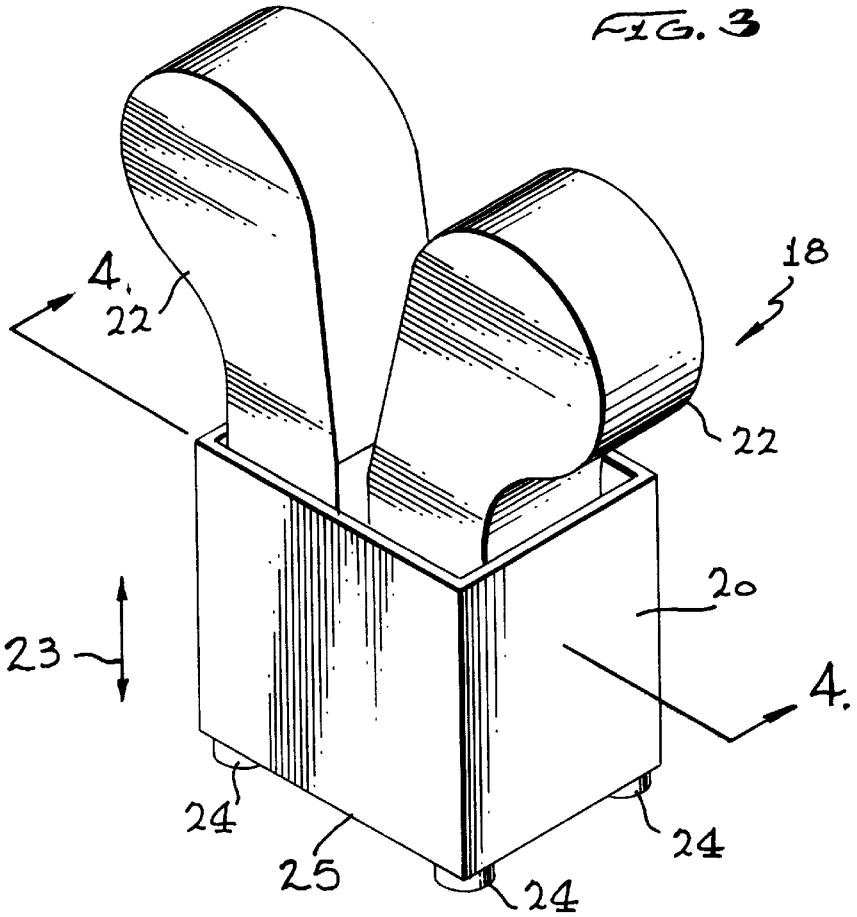
FIG. 3 is a perspective view of the broadband radio frequency radiating element.

Referring to FIG. 3, each broadband radio frequency radiating element 18 has the same configuration with a generally parallelopiped, hollow body 20, a pair of ear-like arms 22 extending outwardly from a common outer face of the body in a direction generally parallel to a first direction 23 perpendicular to an attachment base 25, and four weldment bosses 24 located at the four corners of the rectangular attachment base 25. The body 20 and the two ear-like arms 22 of each broadband radio frequency radiating element 18 are, taken together, of a one-piece construction, preferably prepared by injection molding a polymeric material into a die cavity defining the shape of the body and the ear-like arms. An important economy is achieved by making the broadband radio frequency radiating elements 18 of one-piece construction, rather than two-piece or multiple-piece construction. The polymeric material is most preferably glass-fiber-reinforced polyetherimide (PEI). Other than the lower faces of the weldment bosses 24, the entire outer surface of each broadband radio frequency radiating element is coated with an electrically conductive metallization coating 26. Coating is preferably accomplished by electroless deposition of copper, gold, or silver to a thickness of at least about 0.0015 inches.

Figure 4:
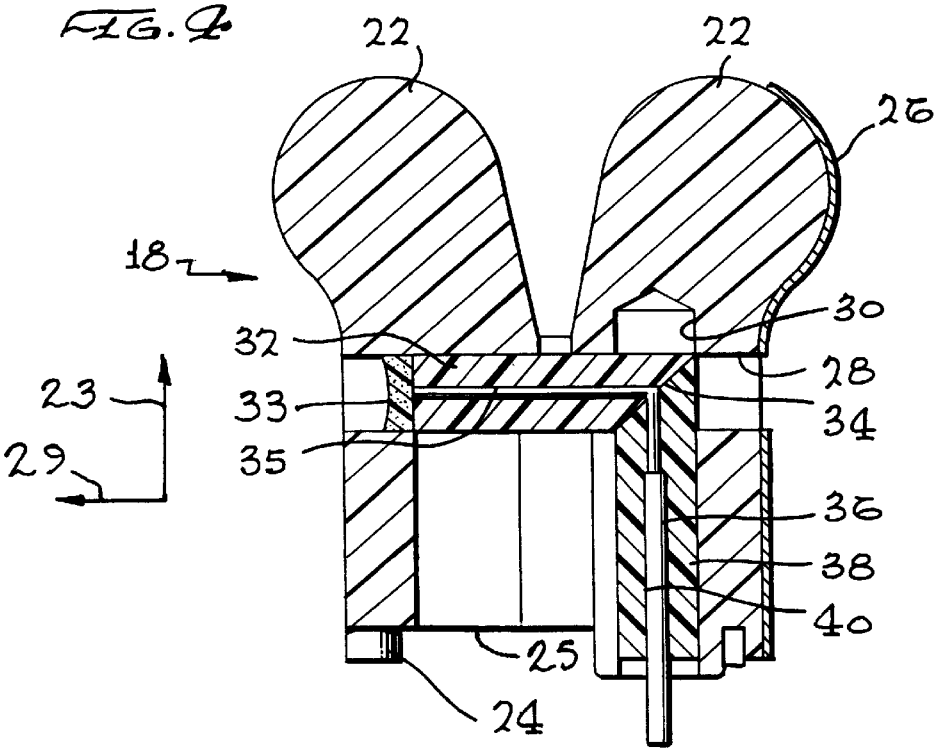
FIG. 4 is a sectional view of the broadband radio frequency radiating element of FIG. 3, taken along lines 4—4.

Referring to FIG. 4, the broadband radio frequency radiating element 18 is molded with a first transmission line cavity 28 extending parallel to a second direction 29 that lies parallel to the attachment base 25 (and thence perpendicular to the direction 23). The broadband radio frequency radiating element 18 is also molded with a second transmission line cavity 30 extending parallel to the first direction 23 and intersecting the first transmission line cavity 28 to form a generally "L"-shaped cavity. A first cylindrical insulator 32, having a bevelled end at location 34, is received within the first transmission line cavity 28. The insulator 32 has an axial opening 35 therein for receiving a center conductor transmission line 36. A second cylindrical insulator 38, also having a bevelled end at location 34, is received within the second transmission line cavity 30. The insulator 32 has an axial opening 35 therein for receiving a center conductor transmission line 36. The insulator 38 has an axial opening 40 therein for receiving a further portion of the center conductor transmission line 36. The first insulator 32 with center conductor 36 received therein is fitted together with the second insulator 38, with the insulators 32 and 38 faced together at location 34, to form a continuous, generally "L"-shaped insulator surrounding a center conductor. A small amount of epoxy is applied as a plug 33 to retain the first insulator 32 in position. When fully assembled, the L-shaped conductor 36 and the transmission line cavities 28, 30 serve as a coaxial transmission line for RF energy travelling to or from the ear-like arms 22.

Figure 5:
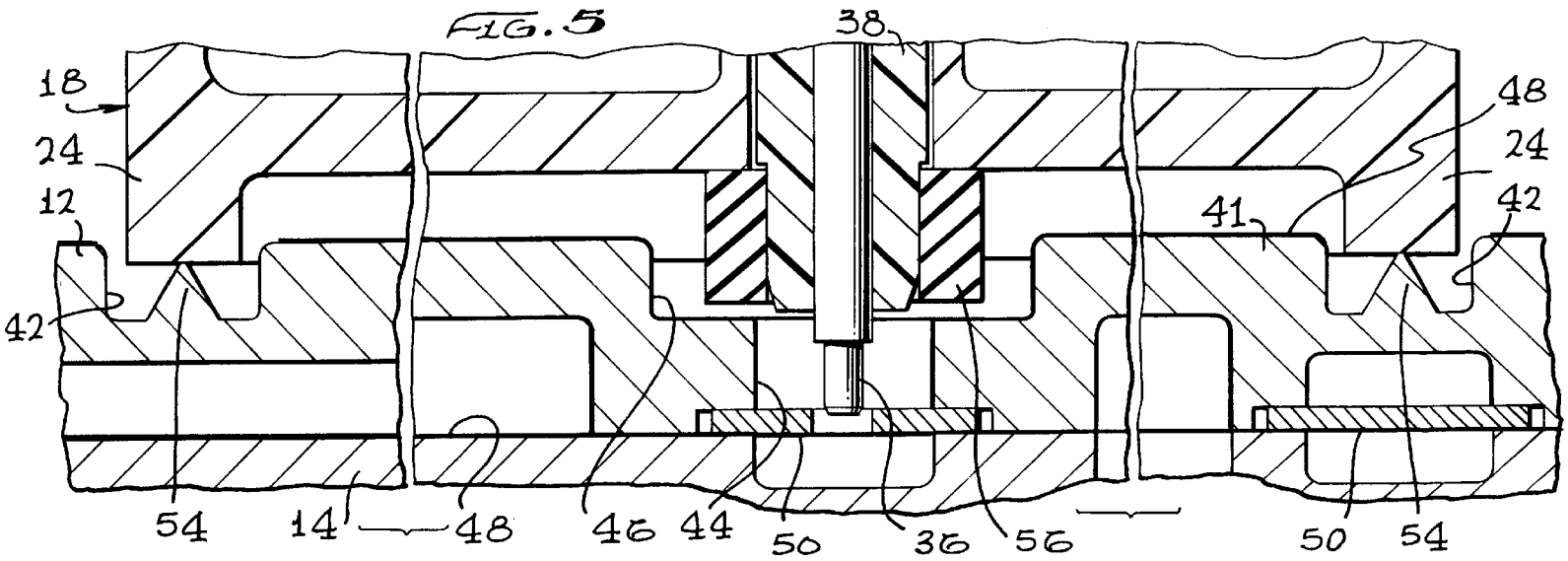
FIG. 5 is a sectional view of the antenna of FIG. 1, but taken during an intermediate stage of assembly prior to fastening of an broadband radio frequency radiating element to the forward feed plate.

Referring to FIG. 5, the forward feed plate 12 is a generally flat plate injection molded from a polymeric material, most preferably the same polymeric material as the broadband radio frequency radiating elements 18 to allow ultrasonic welding of the plate and the radiating elements. A front surface 41 of the forward feed plate 12 has sets of four recesses 42, one set of four recesses for each of the broadband radio frequency radiating elements 18, into which the broadband radio frequency radiating element bosses 24 are received during assembly. An opening 44 and entrance recess 46 are provided for receiving the center conductor 36 of each broadband radio frequency radiating element.

The outer surface of the forward feed plate 12 is covered with a metallization 48 covering the surface except for the recesses 42 that are to receive the broadband radio frequency radiating element weldment bosses 24. Circuit boards, illustrated at numeral 50, are provided on an aft-facing surface of the forward feed plate 12 for providing electrical interconnections with the broadband radio frequency radiating elements 18.

Upon assembly of the broadband radio frequency radiating elements 18 to the forward feed plate 12, the bosses 24 of each broadband radio frequency radiating element 18 are positioned within the recesses 42 of the forward feed plate 12, as shown in FIG. 5. The bosses 24 rest upon energy directors 54, which are upwardly projecting tapered, knife-edge members molded integrally in the bottoms of the recesses 42 of the feed plate 12. A gasket 56 constructed of an electrically conductive spring wire, such as gold-plated copper-beryllium alloy wire, encircles the outer end of the second insulator 38.

Figure 6:
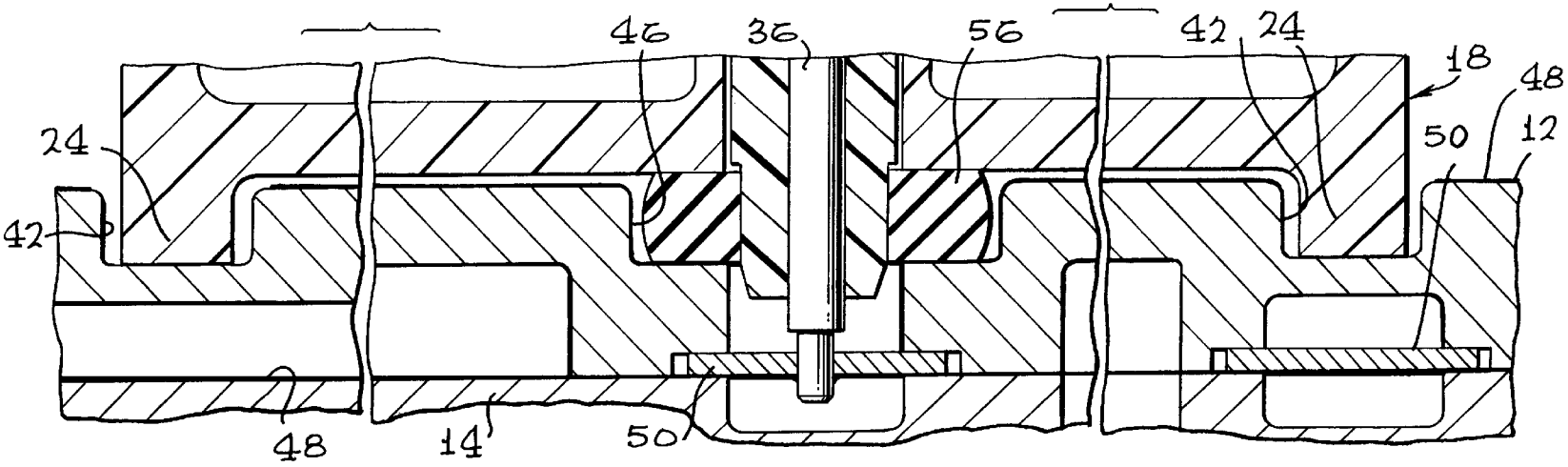
FIG. 6 is a sectional view similar to that of FIG. 5, after joining the broadband radio frequency radiating element to the forward feed plate.

Ultrasonic energy is applied to the contact region between the bosses 24 and the energy directors 54, and downward pressure is applied to the broadband radio frequency radiating elements resulting in a fused unitary welding of the broadband radio frequency radiating elements 18 to the forward plate 12, as shown in FIG. 6. As a result of the ultrasonic welding, the broadband radio frequency radiating elements are firmly secured to the forward feed plate 12, and interconnection between the metallization 26 on the broadband radio frequency radiating elements and the metallization 48 on the forward feed plate 12 is achieved via the mesh gasket 56, which is dimensioned so as to be compressed on mounting of the broadband radio frequency radiating elements. At the conclusion of the assembly of the broadband radio frequency radiating elements 18 to the forward feed plate 12, the end of the transmission line 36 extends through an opening in a circuit board lead 50 and is soldered in place.

The center feed plate 14 and the aft feed plate 16 are molded, preferably injection molded of the same polymeric material as the broadband radio frequency radiating elements 18. Various circuit board interconnections, interconnection pins, and other elements as necessary to provide a completed interconnection scheme are provided on the center and aft feed plates. The three molded plastic feed plates may be readily molded with tight tolerances, which are necessary for matching channel halves and to obtain uniformly predictable radiation characteristics. The plates and broadband radio frequency radiating elements may be molded with relatively thin walls, providing a low weight to the structure.

The thermoplastic polymeric material which is preferably used for injection molding of the broadband radio frequency radiating elements and the feed plates is an electrical non-conductor which has excellent thermal stability, high strength, and good heat resistance. The preferred material is a glass fiber reinforced polyetherimide (PEI). This material is heat-resistant to 400° F., can be ultrasonically welded, and can be electroless plated.

As shown in FIGS. 7 and 8, the interconnection means 58, sometimes termed a suspended stripline and depicted in FIG. 5 as circuit board 50, includes a dielectric substrate strip 60 clamped between parts of the feed plates 12 and 14 adjacent to the feed plate surface channels 62 and 64. A copper trace 66 is deposited upon the surface of the substrate sheet 60 and spaced apart from the conductive metallization 48.

Referring to FIG. 7, some of the suspended striplines 58 make connection via pins 68, extending through the aft feed plate 16, to external connectors 70. The external connectors 70 are held in place by threaded stud members 72. The circuit boards 50 are arranged so as to conduct in-phase excitation signal voltages to the transmission lines 36 of the broadband radio frequency radiating elements 18. The path lengths from the connectors 70 to the transmission lines 36 are accordingly all made of the same length. As the number of broadband radio frequency radiating elements 18 increases, the use of multiple flat plates becomes necessary in order to produce equal lengths of the electrical conductors. The inventors have arranged equal-length electrical conductors for a prototype antenna having 128 broadband radio frequency radiating elements using a total of three plates.

FIG. 9 depicts the steps in the fabrication of the antenna 10. The broadband radio frequency radiating elements 18 are injection molded in the shape and with the material previously described, numeral 80. The surfaces of the broadband radio frequency radiating elements are metallized, numeral 82, and the metallization is removed at the weldment bosses 24, numeral 84. The insulators 32 and 38, and the transmission line 36 are fabricated, numeral 86, and then installed, numeral 88. The broadband radio frequency radiating element 18 subassembly is complete.

The three feed plates 12, 14, and 16 are fabricated, numeral 90. They are then metallized, as described previously, numeral 92. The plates are patterned and photoetched to remove any excess metallization coating, numeral 94.

The studs 19 are installed to the forward plate 12 and ultrasonically welded in place, numeral 96. The broadband radio frequency radiating element subassemblies are ultrasonically welded to the forward plate 12, numeral 98. The circuit boards 50 are installed to the forward plate 12, and the transmission lines 36 and through pins are soldered, numeral 100. These soldering steps may be performed by automated soldering equipment familiar in the microelectronics industry. The forward plate subassembly is complete.

The center plate 14 is installed to the forward plate subassembly, numeral 102 by placement over the studs 19.

The circuit board 50 is installed to the center plate 14, numeral 104. The forward plate/center plate subassembly is complete.

The studs 72 required to anchor and support the connectors 70 are ultrasonically welded to the aft plate, numeral 106. The aft plate is then installed to the forward plate/center plate subassembly over the stud members 19, numeral 108. The nuts are installed to the studs 19 and 72 and tightened, numeral 110. The studs may instead be polymeric material that is ultrasonically welded together. The external RF connectors are installed, numeral 112.

The present invention has been reduced to practice with a three-plate antenna like that disclosed herein, with 128 broadband radio frequency radiating elements. The weight of the antenna is about 2½ pounds, as compared with about 5 pounds for conventional antennas, and it is believed that further design refinement will lead to an even lower weight for the antenna of the invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing a radio frequency antenna, comprising the steps of:

preparing a plurality of broadband radio frequency radiating elements, the step of preparing a plurality of broadband radio frequency radiating elements including the steps of molding each broadband radio frequency radiating element from a first polymeric material, metallizing a portion of each broadband radio frequency radiating element so that there is no metallization on an attachment region of each broadband radio frequency radiating element, and installing a transmission line to each broadband radio frequency radiating element;

preparing a support structure comprising a support base, and a plurality of electrical conductors thereon, each electrical conductor extending to one of a plurality of attachment locations; and affixing the attachment region of one of the broadband radio frequency radiating elements to each of the plurality of attachment locations of the support structure, with the transmission line of each broadband radio frequency radiating element in electrical communication with the electrical conductor extending to the respective attachment location.

2. The method of claim 1, wherein the step of molding includes the step of injection molding each broadband radio frequency radiating element.

3. The method of claim 1, wherein the step of metallizing includes the step of plating a metallic coating onto each of the broadband radio frequency radiating elements, and thereafter removing the metallic coating from each of the broadband radio frequency radiating elements at an attachment boss location.

4. The method of claim 1, wherein the step of preparing a support base includes the step of preparing a feed plate having a second plurality of electrical conductors thereon.

5. The method of claim 1, wherein the step of preparing a support base includes the step of preparing at least two feed plates, and attaching the at least two feed plates together in a facing relationship.

6. The method of claim 5, wherein the step of affixing is performed after the step of preparing and prior to the step of attaching.

7. The method of claim 1, wherein the step of affixing includes the step of ultrasonically welding each broadband radio frequency radiating element to the support base.

8. The method of claim 1, wherein the step of preparing a support structure includes the steps of molding the support structure from a second polymeric material, forming a pattern of electrically conductive traces on the support structure.

9. The method of claim 1, wherein the step of preparing a plurality of broadband radio frequency radiating elements includes the step of preparing a plurality of generally parallelopiped, hollow bodies, each of the bodies having a pair of ear-like arms extending outwardly from a common outer face of the body.

10. A method for preparing a radio frequency antenna, comprising the steps of:

preparing a plurality of broadband radio frequency radiating elements, the step of preparing a plurality of broadband radio frequency radiating elements including the steps of injection molding each broadband radio frequency radiating element from a first polymeric material, metallizing each broadband radio frequency radiating element, removing the metal layer from each broadband radio frequency radiating element in an attachment region thereof, and installing a transmission line to each broadband radio frequency radiating element;

preparing a support structure, the step of preparing a support structure comprising the steps of molding a flat plate support base having a plurality of attachment locations on a first side thereof, from a second polymeric material, and positioning a plurality of electrical conductors on the support base, each electrical conductor extending to one of the plurality of attachment locations; and affixing an broadband radio frequency radiating element to each of the plurality of attachment locations, with the transmission line of each broadband radio frequency radiating element in electrical communication with the electrical conductor extending to the respective attachment location.

11. The method of claim 10, wherein the step of preparing a support structure includes the step of preparing at least two feed plates, and attaching the at least two feed plates together in a facing relationship.

12. The method of claim 11, wherein the step of affixing is performed after the step of preparing and prior to the step of attaching.

13. The method of claim 10, wherein the step of affixing includes the step of ultrasonically welding each broadband radio frequency radiating element to the support base.

14. The method of claim 10, wherein the step of injection molding each broadband radio frequency radiating element comprises the step of injection molding a broadband radio frequency radiating element comprising a body having an attachment base, two ear-like arms extending from the body in a first direction lying perpendicular to the attachment base, an first transmission line cavity extending in a second direction perpendicular to the attachment base, and a second transmission line cavity extending in the first direction.

15. The method of claim 10, wherein the step of injection molding each broadband radio frequency radiating element from a first polymeric material and the step of molding a flat plate support base having a plurality of attachment locations on a first side thereof from a second polymeric material each utilize the same polymeric material.

16. The method of claim 9, wherein the step of preparing a plurality of broadband radio frequency radiating elements include the step of preparing a plurality of generally parallelopiped, hollow bodies, each of the bodies having a pair of ear-like arms extending outwardly from a common outer face of the body.

17. A method for preparing a radio frequency antenna, comprising the steps of:

preparing a first plurality of broadband radio frequency radiating elements, the step of preparing the first plurality of broadband radio frequency radiating elements including the steps of injection molding each broadband radio frequency radiating element from a first polymeric material, each broadband radio frequency radiating element comprising a body having an attachment base, two ear-like arms extending from the body in a first direction lying perpendicular to the attachment base, and a transmission line cavity extending through the body, metallizing each broadband radio frequency radiating element, removing the metal layer from each broadband radio frequency radiating element in the attachment base region thereof, and installing a transmission line to each broadband radio frequency radiating element;

molding a first flat plate support plate having a first plurality of attachment locations on a first side thereof, from a second polymeric material;

metallizing the first flat support plate;

affixing an broadband radio frequency radiating element to each of the first plurality of attachment locations;

providing a second plurality of electrical conductors on a second side of the first support plate;

molding a second flat support plate, from a third polymeric material;

metallizing the second flat support plate;

providing a third plurality of electrical conductors on the second support plate;

electrically connecting the transmission lines to the second plurality and third plurality of electrical conductors, so that an electrical conductor extends to each of the transmission lines; and mechanically connecting the first flat support plate to the second flat support plate in a face-to-face relationship.

* * * * *